US005892486A

United States Patent [19]

Cook et al.

[11] Patent Number: 5,892,486

[45] Date of Patent: Apr. 6, 1999

[54] BROAD BAND DIPOLE ELEMENT AND ARRAY

[75] Inventors: Scott J. Cook; John Michael Vezmar, both of Garner, N.C.

[73] Assignee: Channel Master LLC, Smithfield, N.C.

[21] Appl. No.: 731,346

[22] Filed: Oct. 11, 1996

[51] Int. Cl.[6] ..... H01Q 9/28; H01Q 21/08

[52] U.S. Cl. ..... 343/795; 343/817; 343/821

[58] Field of Search ..... 343/795, 821, 343/822, 815, 817; 333/26; H01Q 1/38, 9/16, 9/28, 21/08

[56] References Cited

U.S. PATENT DOCUMENTS

| | | | |
|---|---|---|---|
| Re. 29,296 | 7/1977 | Krutsinger et al. | 343/795 |
| 3,239,838 | 3/1966 | Kelleher | 343/795 |
| 3,747,114 | 7/1973 | Shyhalla | 343/795 |
| 3,845,490 | 10/1974 | Manwarren et al. | 343/821 |
| 3,987,445 | 10/1976 | Olyphant, Jr. | 343/829 |
| 3,995,277 | 11/1976 | Olyphant, Jr. | 343/846 |
| 4,054,874 | 10/1977 | Oltman, Jr. | 343/700 MS |
| 4,204,213 | 5/1980 | Wheeler et al. | 343/706 |
| 4,287,528 | 9/1981 | Ellis, Jr. | 343/700 MS |
| 4,686,536 | 8/1987 | Allcock | 343/700 MS |
| 4,825,220 | 4/1989 | Edward et al. | 343/795 |
| 4,847,626 | 7/1989 | Kahler et al. | 343/700 MS |
| 4,916,457 | 4/1990 | Foy et al. | 343/770 |
| 4,943,811 | 7/1990 | Alden et al. | 343/814 |
| 5,039,994 | 8/1991 | Wash et al. | 343/813 |
| 5,061,944 | 10/1991 | Powers et al. | 343/795 |
| 5,097,884 | 3/1992 | Turner | 128/804 |
| 5,214,439 | 5/1993 | Reed | 343/877 |
| 5,274,391 | 12/1993 | Connolly | 343/820 |
| 5,280,286 | 1/1994 | Williamson | 342/44 |
| 5,371,509 | 12/1994 | Wallace, Jr. et al. | 343/741 |
| 5,387,919 | 2/1995 | Lam et al. | 343/821 |
| 5,467,099 | 11/1995 | Bonebright et al. | 343/767 |

OTHER PUBLICATIONS

J. P. Daniel, et al., "Research on Planar Antennas and Arrays: 'Structures Rayonnantes'", IEEE Antennas Propaga. Mag., vol 35, No. 1, pp. 14–38, Feb. 1993, as reprinted in Pazar and Schaubert, MicroStrip Antennas, IEEE Press, pp. 26, 43–44.

*Primary Examiner*—Michael C. Wimer
*Attorney, Agent, or Firm*—Darby&Darby

[57] ABSTRACT

An improved dipole antenna array with high radiation directivity and broad bandwidth is disclosed. Each dipole antenna is driven by a balun structure composed of an unbalanced J-shaped transmission line placed over a pair of ground plane extensions that are separated by a channel. The dipole antenna arms are connected to an intermediate point on the ground plane extensions so that the balun structure extends beyond the dipole antenna. The length of the dipole arms, their position on the ground plane extensions, and the extent to which the balun extends beyond the dipole antenna can be chosen to determine the desired operating frequency range. The antennas are fabricated on ground and circuit planes separated by a dielectric material and composed of conducting material deposited on dielectric sheets. A planar array of dipole antennas is formed with the ground plane circumscribing each antenna in the array to improve directivity. An electromagnetic reflecting plane is placed parallel to the array to increase radiation efficiency.

17 Claims, 6 Drawing Sheets

BROAD BAND DIPOLE ELEMENT AND ARRAY

BACKGROUND OF THE INVENTION

1. Field of the Invention

The invention pertains to an array of balun driven dipole elements and arrays of such dipoles useful as a microwave radiating antenna.

2. Prior Art

Dipole antennas are well known in the prior art. A typical dipole antenna consists of dipole arms which are fed by balanced transmission lines or a balun connected to an unbalanced transmission line. In that latter case, the dipole is driven by an open-circuited unbalanced transmission line which is overlaid on the grounded antenna structure to form the balun and can either extend over the dipole in an "L" shape or be bent back towards the ground plane in a "J" shape. The operating frequency of a dipole antenna is determined by its geometric structure and is generally limited to a narrow bandwidth.

A typical example of a dipole antenna is disclosed in U.S. Pat. No. 3,845,490 to Manwarren et al. This reference discloses a stripline slotted balun dipole antenna, where a single "L" shaped driving transmission line is sandwiched between two dielectric sheets, each containing a balun dipole antenna. A "J" shaped microstrip transmission line is disclosed in U.S. Pat. No. 4,825,220 to Edward et al. This reference describes a planar balun dipole antenna and a structure that allows the geometry to be physically altered after fabrication to tune the antenna to a desired frequency. Edward also describes the use of a reflecting surface located perpendicular to the antenna to increase radiation efficiency in the direction tangent to the balun. In both these references, the disclosed antennas are optimized for a single frequency.

U.S. Pat. No. 3,239,838 to Kelleher discloses a dipole antenna mounted in an open-faced resonant cavity. This reference discloses a dipole antenna where the dipole arms are not placed at the termination points of the balun transmission lines, but rather, are placed near their ends, with the remaining part of the balun forming stubs. Additionally, the microstrip transmission line used to drive the antenna is not extended into the stub region. Further, Kelleher does not teach or suggest the use of these stubs to increase the bandwidth of the antenna.

Balun dipole antennas are particularly suited to fabrication in planar arrays. For example, U.S. Pat. No. 3,747,114 to Shyhalla illustrates a flat planar array of microwave radiating elements. The dipole elements are formed on a planar dielectric substrate. The transmission line distribution circuit which drives the antennas is also formed on a planar substrate. Shyhalla discloses circumscribing the entire antenna array within a protective frame to provide rigidity. However, no suggestion is made to circumscribe each dipole antenna with a ground plane extension.

SUMMARY OF THE INVENTION

The present invention provides an improvement to the conventional geometry of a balun driven dipole antenna which significantly increases the bandwidth of the antenna. Specifically, the improved design of the antenna allows for operation at peak efficiency for a wider range of frequencies. The present invention also provides an improvement to the conventional geometry of planar arrays of dipole elements. Non-symmetric elements suffer from unwanted beam shaping and steering which can degrade the radiation pattern of the array. The improvement minimizes shaping and steering of the radiation pattern by increasing the array symmetry as viewed from each antenna element.

The invention includes a balun-driven dipole antenna where the balun to which the dipole is connected is extended beyond the connection point, forming extension stubs.

The improved dipole antenna has a predetermined optimal high frequency which is dependent on the dimensions of the dipole arms and the balun. To maintain optimal performance as the applied frequency drops, the length of the dipole arms must increase to accommodate an increased wavelength. Because of the improved antenna geometry, when the frequency is reduced below the optimal high frequency, the electrical length of the dipole arm is dynamically increased to include enough of the stub extension so as to maintain the optimal length for efficient radiation.

Thus, the improved dipole antenna geometry results in a range of optimal operating frequencies from the chosen high frequency to a lower frequency dependent on the length of the stubs. Accordingly, there is an enhanced bandwidth where the antenna will radiate at peak efficiency.

The improved dipole antenna can be easily fabricated as a planar array in either a microstrip or stripline configuration. The present invention minimizes element pattern shaping and steering by framing each element within the ground plane, thus making the environment as seen from each discrete element more symmetric and thereby improving the shape of the radiation pattern of the array.

A further improvement in radiation efficiency normal to the array plane is achieved by placing a reflector plate parallel to and approximately one-quarter wavelength below the array.

DETAILED DESCRIPTION OF THE PREFERRED EMBODIMENT

Figure 1:
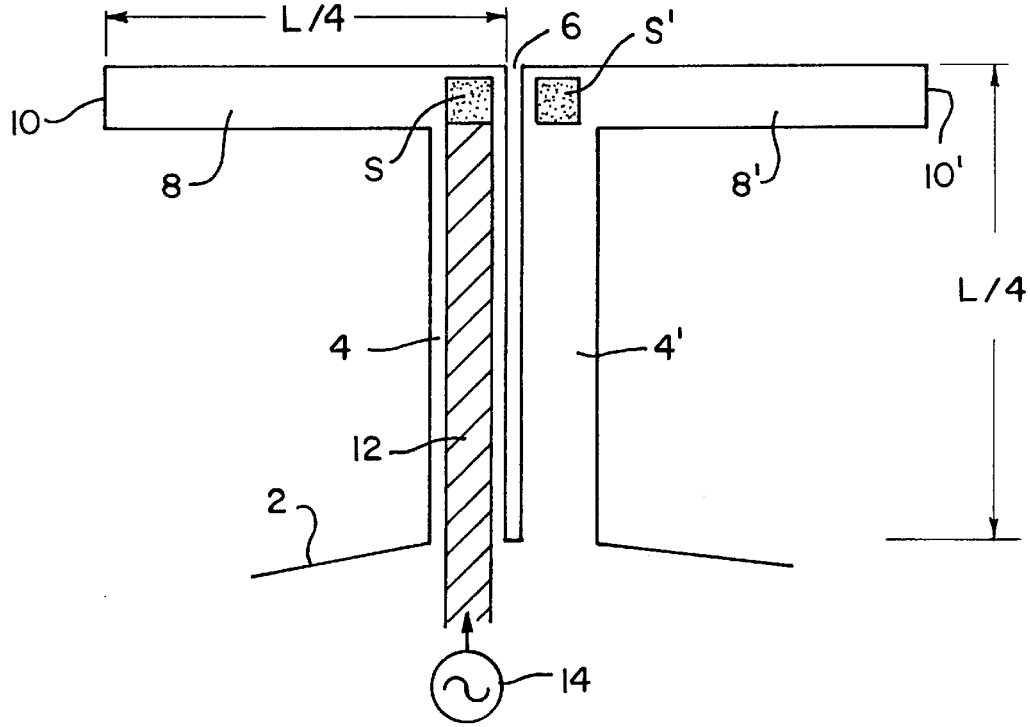
FIG. 1 PRIOR ART
FIG. 1 is an illustration of a conventional dipole antenna.

A conventional dipole antenna having a limited optimized range of radiation is shown in FIG. 1. The antenna consists of a ground plane 2 having two parallel extensions 4, 4' proximal to the ground plane. The parallel ground plane extensions 4, 4' are separated by a channel 6. Connected at the ends of the extensions 4, 4' are arms 8, 8' which extend perpendicular to extensions 4, 4' in opposite directions. Arms 8, 8' terminate at points 10, 10' and form a dipole radiating element. Overlaid on the ground plane 2 and extensions 4, 4' is a transmission line which can be in the form of a microstrip 12. This unbalanced transmission line microstrip 12, is physically connected to one dipole arm 8 at S.

To tune the antenna to a particular operating frequency f having wavelength L, the length of the ground plane extensions 4, 4' is chosen so that the distance between S and S' down channel 6 and back is approximately L/2. If the microstrip 12 is driven by a radio frequency (RF) source 14 with frequency f, the signal at point S' will be one-half wavelength L from point S as measured around the channel. Thus, the RF signal at point S will be 180 degrees out of phase with the signal at point S'. This condition creates a "virtual" short circuit at point S' to correspond with the physical one at S. In this state, the currents along arms 8, 8' are in phase and balanced at the desired operating frequency f. As a result, the balanced dipole is fed by a balanced source with the equivalent circuit being an RF source of frequency f located between the two dipole arms 8, 8'.

Maximum antenna efficiency is achieved when the dipole arms 8, 8' are made to have an electrical length (defined as the distance between the RF short circuit point and the end of the dipole arm) corresponding to L/4 of the tuned frequency f, so that the total dipole length (10 to 10') is approximately L/2.

It can be appreciated that the operating range of this antenna is narrow. The center or optimal frequency is dependent on the geometry of the antenna and the position of the electrical connection of the microstrip to the ground plane at S. Raising or lowering the driving frequency results in dipole arms that are too short or too long. This creates a mismatch of impedances and more energy may be reflected instead of transmitted.

Figure 2A:
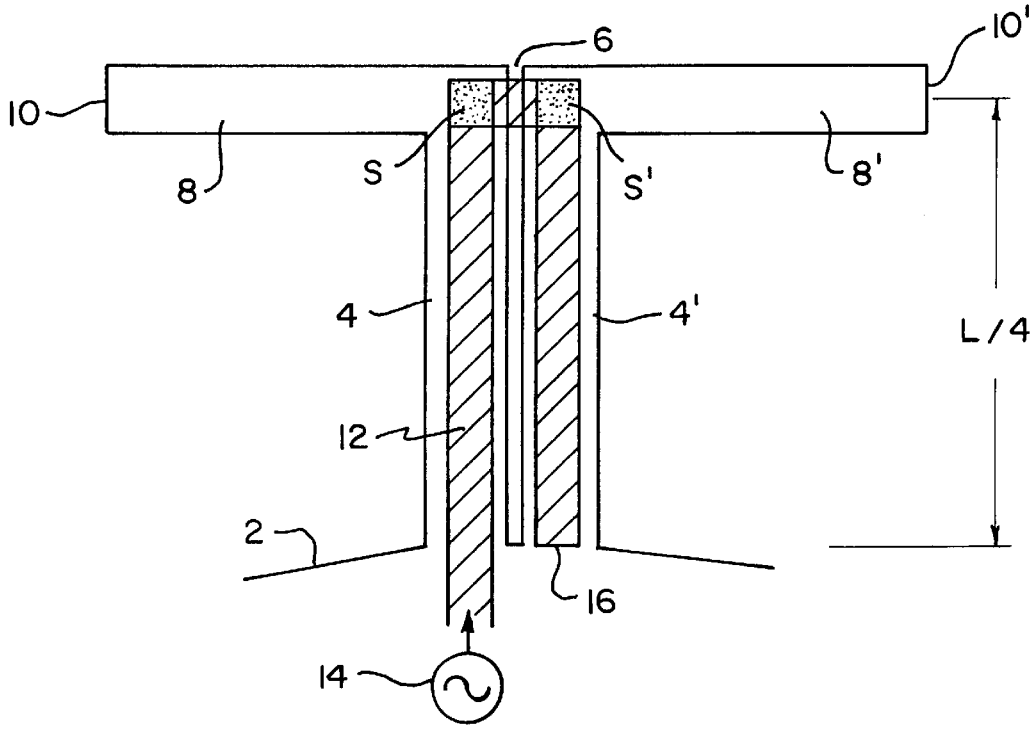
FIG. 2a PRIOR ART
FIG. 2*a* is an illustration of a conventional dipole antenna driven by an openended transmission line indicating the location of the RF short circuit point when the antenna is driven at its tuned frequency.

Another type of dipole antenna construction creates a balun without a physical connection between the conductor and ground plane as shown in FIG. 2*a*. In this design, the microstrip 12 is configured in a "J" shape and overlays the ground plane extensions 4, 4' rather than being physically attached as shown in FIG. 1. The microstrip 12 is separated from the extensions 4, 4' by a low-loss dielectric spacer (not shown). The characteristic impedance of the antenna can be chosen by adjusting the width of microstrip 12 and the thickness of the dielectric spacer.

When a signal 14 with frequency f (and wavelength L) is applied to the microstrip transmission line 12, the signal is coupled to microstrip 12 and travels along it to the end 16. The signal is then reflected back. An "RF short circuit" is formed a distance L/4 from the end 16 of the microstrip 12 and power will flow from the microstrip into the ground plane 2 at that point. The combination of the ground plane extensions 4, 4' and the unbalanced microstrip transmission line 12 forms the balun (short for balanced to unbalanced) structure, the balanced structure being the dipole arms 8, 8'.

If the length of the microstrip 12 in FIG. 2*a* is chosen so that the distance between point S' and the microstrip end 16 is L/4, the RF short circuit will form at point S', replacing the physical short required in the dipole antenna of FIG. 1. Likewise, a "virtual" RF short circuit point, S, forms one-half wavelength down channel 6 and back towards the other dipole arm 8. The position of the RF short circuit points shifts with changes in the frequency of the driving signal 14. If the geometry of the extensions 4, 4' is chosen so that S and S' are aligned with the dipole arms 8, 8' and the S to 10 and S' to 10' distances are each L/4, then the antenna will radiate exactly as the antenna of FIG. 1.

Figure 2B:
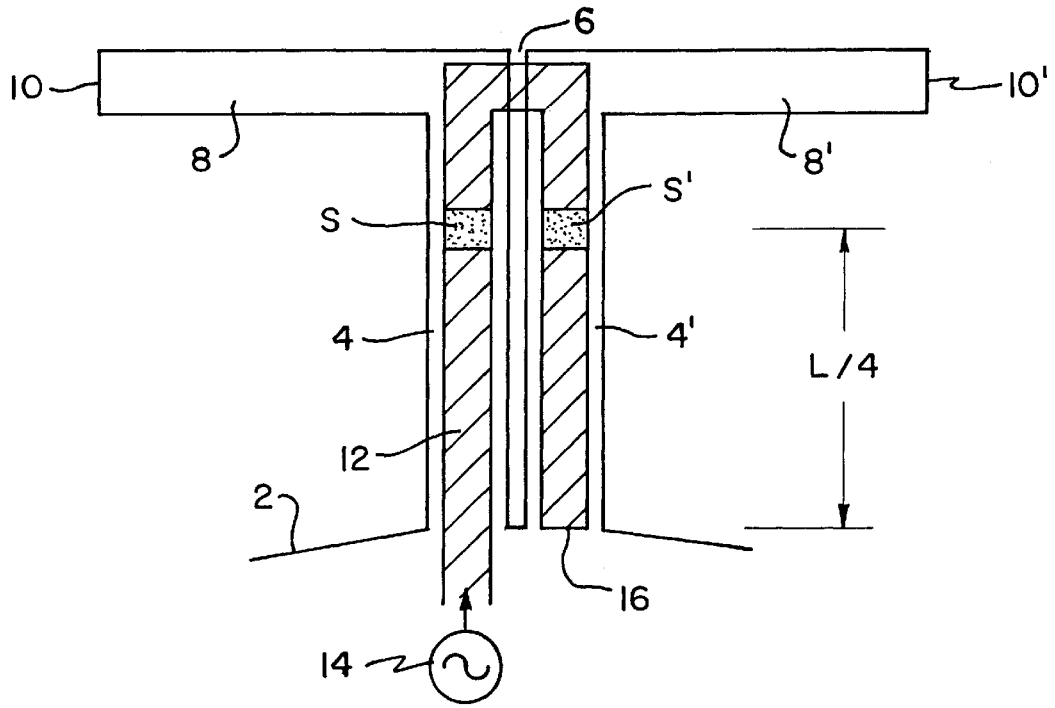
FIG. 2b PRIOR ART
FIG. 2*b* is an illustration of a conventional dipole antenna driven by an open-ended transmission line indicating the location of the RF short circuit point when the antenna is driven at a frequency higher than its tuned frequency.

The operating range of this antenna is also narrow. When the driving frequency is increased, the length of the corresponding wavelength decreases, causing the RF short circuit point S' to shift closer to the end 16 of the microstrip 12 and further from the dipole arm end 10' as shown in FIG. 2*b*. Similarly, the virtual RF short circuit point S also arises further from the dipole arm end 10. Because the ends of the dipole arms 10, 10' are no longer one-quarter wavelength from the virtual short circuit, the efficiency of the antenna is reduced. In this situation the dipole arms are too long for efficient radiation. Analogously, if the applied frequency is lower than the frequency chosen for the constructed antenna, point S' will shift further away from end 16, moving off of extension 4' and onto extension 4, the dipole arms 8, 8' will again be of the wrong length, and radiation efficiency will be compromised.

According to the invention, a dipole antenna construction is provided which permits enhanced peak radiation characteristics across a wider frequency range as compared to known designs. As will be discussed in detail below, the improved design allows for high efficiency antenna operation resulting in as much as a 50% to 75% variation in frequency without substantial loss of power. A salient aspect of the invention is the inclusion of stubs on the balun structure extending beyond the dipole arms to permit a significant bandwidth increase. Because the improved antenna structure is planar, the invention can be inexpensively and easily fabricated in planar arrays on dielectric sheets.

Another aspect of the invention is the improvement created when each element in such a planar array is framed within the ground plane. Circumscribing each antenna element in the array within the ground plane improves the directivity of the radiation pattern normal to the array plane as viewed from a point distant from the array by reducing the shaping and steering effect caused by asymmetries in the array layout.

Figure 3A:
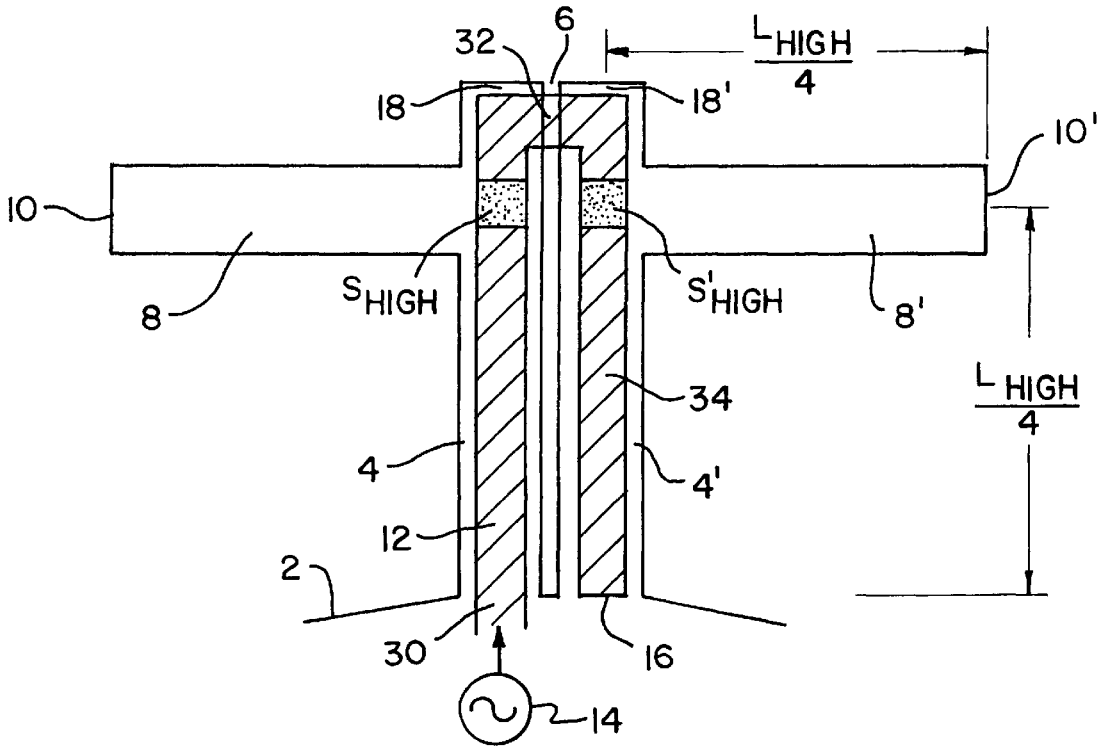
FIG. 3*a* is an illustration of a broad band dipole antenna according to the present invention indicating the location of the RF short circuit point when the antenna is driven at its highest optimal frequency.

FIG. 3*a* shows the structure of a single broad band dipole antenna according to the present invention. The dipole arms 8, 8' are spaced from the distal end of the ground plane extensions 4, 4'. Stubs 18, 18' extend past the arms 8, 8' in line with the extensions 4, 4'. The J-shaped microstrip transmission line 12 is likewise extended past the dipole arms 8, 8' and over the stub region 18, 18'. In this configuration, the J-shaped microstrip transmission line can be defmed as having a source region 30 which connects to the RF source 14 and extends along extension 4 to dipole arm 8, a channel region 32 which extends along the stub region 18 of extension 4, crosses the channel 6, and extends along stub region 18' on extension 4' to the dipole arm 8', and a reflecting region 34 which extends along extension 4' past the dipole arm 8' and terminates near the end of the channel 6.

While the RF short circuit point S' will still shift with changes in frequency as described above, this geometry enables a wide range of frequencies to propagate through the antenna to the dipole arms 8, 8' while still maintaining an electrical dipole arm length of L/4 from the RF short circuit points as required for optimal operation.

The improved antenna can be characterized by an operating frequency range between $f_{high}$ and $f_{low}$, having corresponding wavelengths $L_{high}$ and $L_{low}$. The position of the end 16 of the microstrip transmission line 12 is chosen so that when the balun is fed by applying an RF signal 14 at frequency $f_{high}$, the highest desired frequency of optimal operation, the RF short circuit point $S'_{high}$ arises at a position which is aligned with the dipole arm 8' at a distance $L_{high}/4$ from end 16. Likewise, a virtual RF short circuit arises at point $S_{high}$, a distance $L_{high}/2$ down channel 6 and back up the other extension 4. The length of the dipole arms 8, 8' are chosen so that the distance from $S_{high}$ to 10 and from $S'_{high}$ to 10' is $L_{high}/4$ at $f_{high}$ as shown in FIG. 3*a*. This results in a dipole antenna that is balanced at $f_{high}$ and which will radiate like the dipole illustrated in FIG. 2*a*.

Figure 3B:
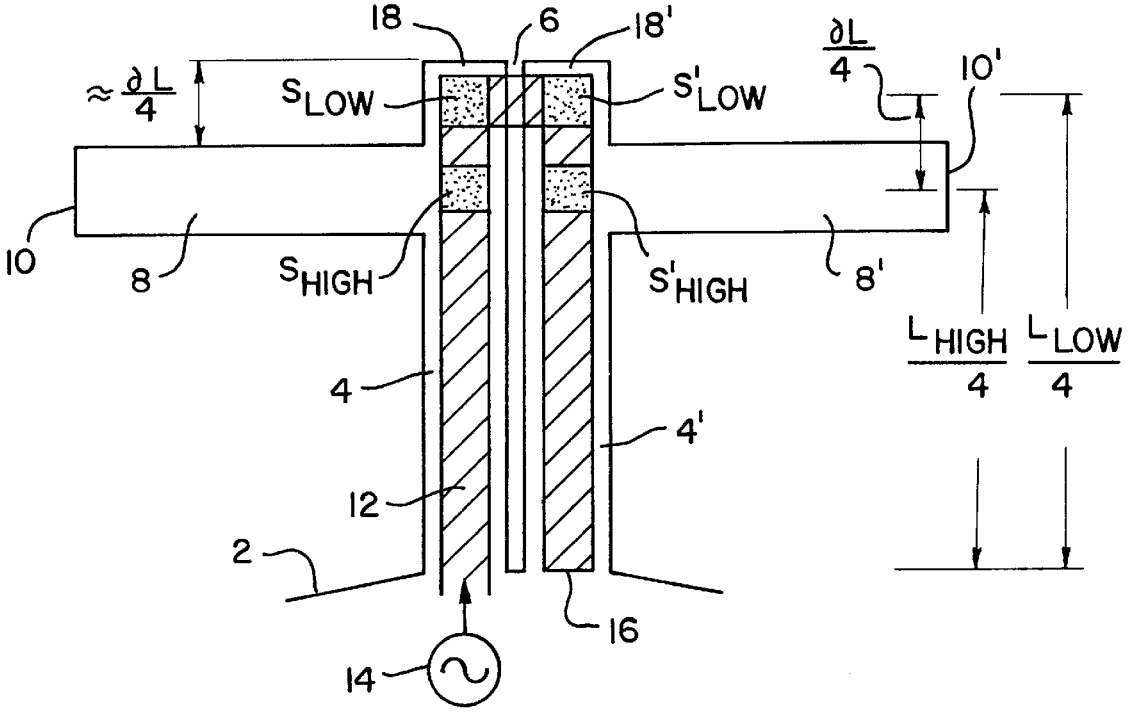
FIG. 3*b* is an illustration of a broad band dipole antenna according to the present invention indicating the location of the RF short circuit point when the antenna is driven at its lowest optimal frequency.
Figure 3C:
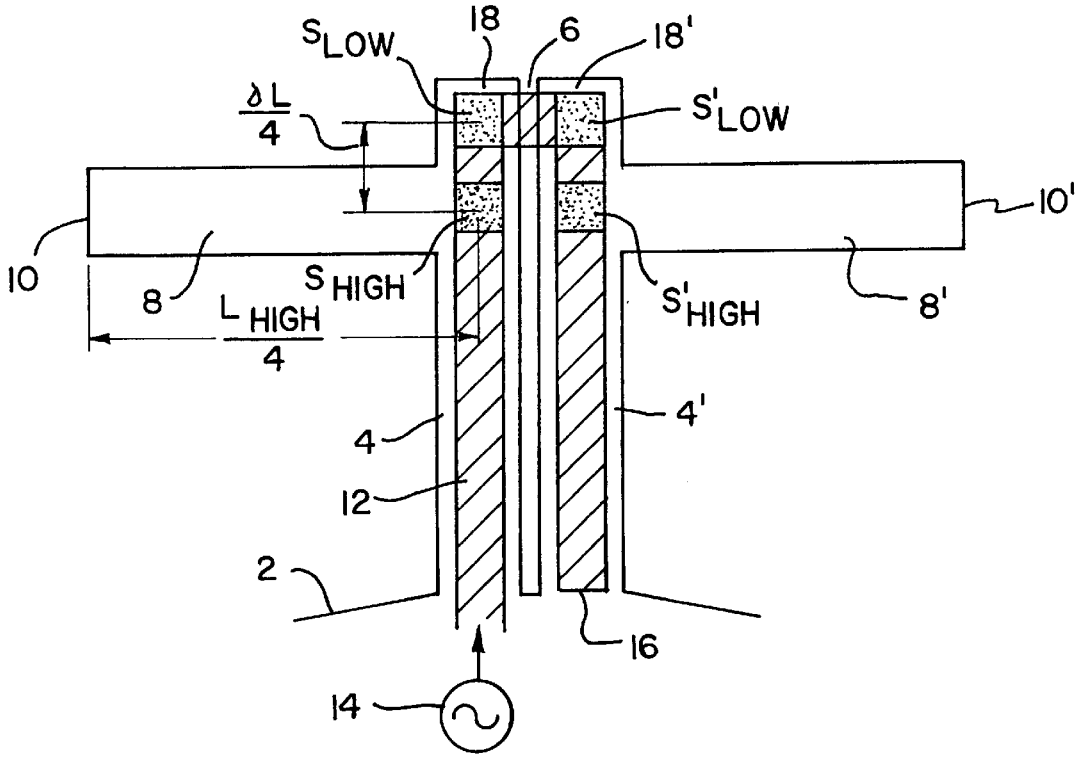
FIG. 3*c* is an illustration of a broad band dipole antenna according to the present invention indicating the determination of the stub length resulting in the lowest optimal frequency.

As illustrated in FIG. 3*b*, the lowest desired frequency of operation is $f_{low}$, having wavelength $L_{low}$, a wavelength dL longer than $L_{high}$. Stubs 18, 18' are designed to extend beyond the dipole arms 8, 8' a distance of about dL/4 to accommodate the shift in RF short circuit points $S_{low}$ and $S'_{low}$ at frequencies below $f_{high}$. FIG. 3*c*.

When $f_{low}$ is applied to transmission line 12, the virtual RF short circuit point $S'_{low}$ forms at a distance $L_{low}/4$ from the microstrip end 16. This position is also dL/4 from the $S'_{high}$ virtual short circuit point. Virtual short circuit point $S_{low}$ forms at a distance $L_{low}/2$ from $S'_{low}$ around the channel 6. This point is also dL/4 from $S_{high}$. FIGS. 3*b*, 3*c*.

If an intermediate frequency f between $f_{high}$ and $f_{low}$, and having wavelength L is applied, the RF short circuit points S, S' will shift up into the stubs 18, 18' a distance equal to $\frac{1}{4}[L-L_{high}]$. The stubs 18, 18' act as extensions to the dipole arms 8, 8' maintaining the S to 10 and S' to 10' distance at the optimal one-quarter wavelength. In effect, the electrical length of the dipole arms 8, 8' is dynamically increased to compensate for a lower applied frequency.

The appropriate antenna length for efficient operation at frequency $f_{low}$ is automatically lengthened relative to the $f_{high}$ antenna length to a maximum length of $L_{low}/4$, (which corresponds to the original distance $S_{high}$ to 10 plus the dL/4 length of the stubs) providing an increase of $df=f_{high}-f_{low}$ over a similar dipole antenna constructed without the stub regions.

In theory, the stubs can be lengthened to allow for extremely wide bandwidths. However, at low frequencies, the RF short circuit points are located within the stubs causing a current flow in the stubs which acts to cancel out the current that would otherwise be radiated by the dipole. The pattern of radiation from the dipole is not influenced, rather the intensity of the field is reduced. To limit the reduction in the efficiency of the antenna caused by the stubs 18, 18', they should not be significantly longer than the dipole arms 8, 8'.

Figure 3D:
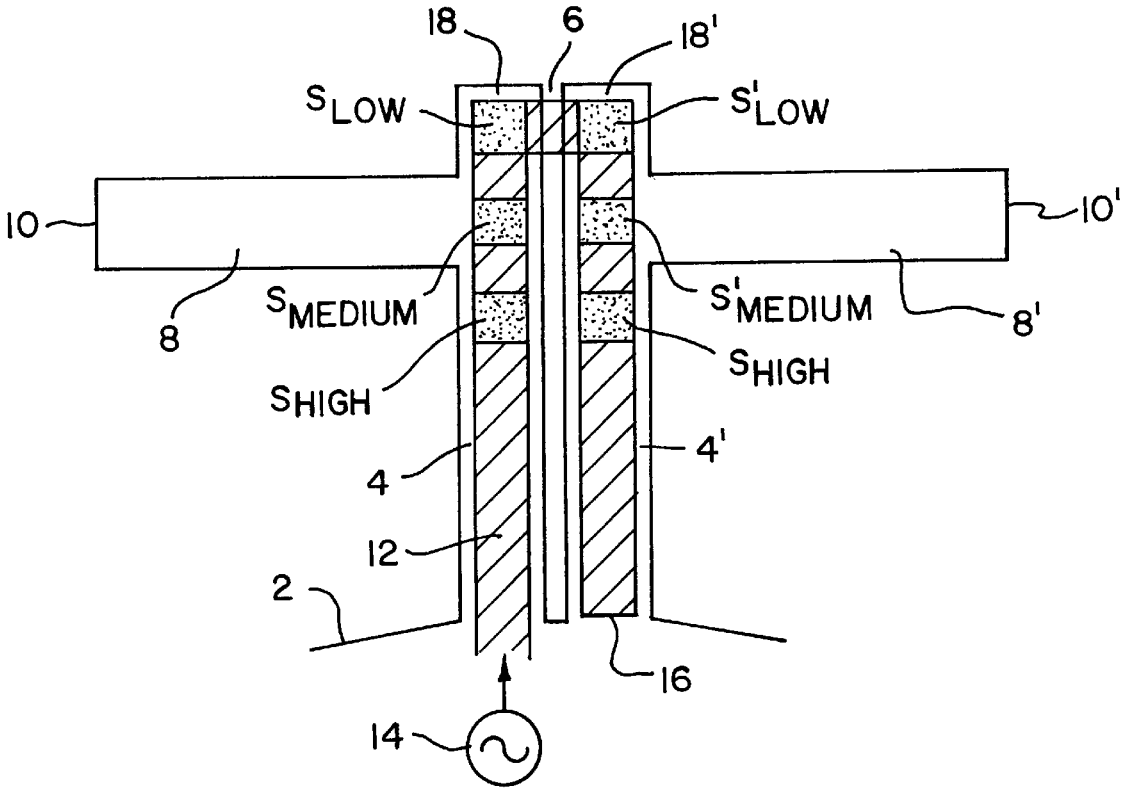
FIG. 3*d* is an illustration of a broad band dipole antenna according to the present invention indicating the location of the RF short circuit point when the antenna is driven at a frequency above its highest optimal frequency.

FIG. 3*d* illustrates an alternative way to gain bandwidth in situations where the need for increased bandwidth outweighs the degradation in the radiation pattern at high frequencies. Degradation in the radiation pattern results where the RF short circuit points are located on the extensions proximal to the arms. Rather than setting the geometry of the dipole and the microstrip such that the RF short circuit points are aligned with the dipole arms 8, 8' (as in FIG. 3*a*), the dipole geometry can be configured such that the short circuit points S, S' for $f_{high}$ arise in between dipole arms 8, 8' and ground plane 2. In this configuration, the apparent length of the dipole arms, $S'_{high}$ to 10' and $S_{high}$ to 10, would be greater than the optimal $L_{high}/4$. As a result, the dipole would not operate at peak efficiency at $f_{high}$. Maximum efficiency is achieved in this design at $f_{medium}$, the frequency where the RF short circuit points $S_{medium}$ and $S'_{medium}$ are aligned with the dipole arms 8, 8'. There will be both a loss of power and a degradation in the radiation pattern when the dipole is driven at frequencies above $f_{medium}$.

Figure 4D:
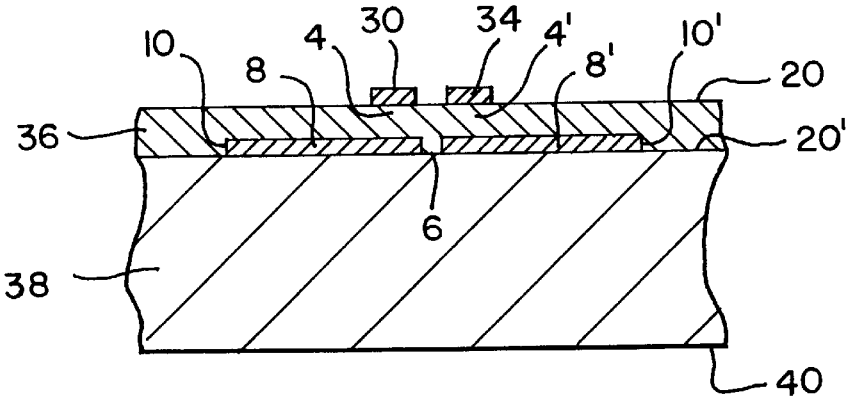
FIG. 4*d* is a cross-sectional view of a dipole antenna array illustrating the arrangement of the circuit plane, the ground plane, and the reflecting plane.
Figure 4A:
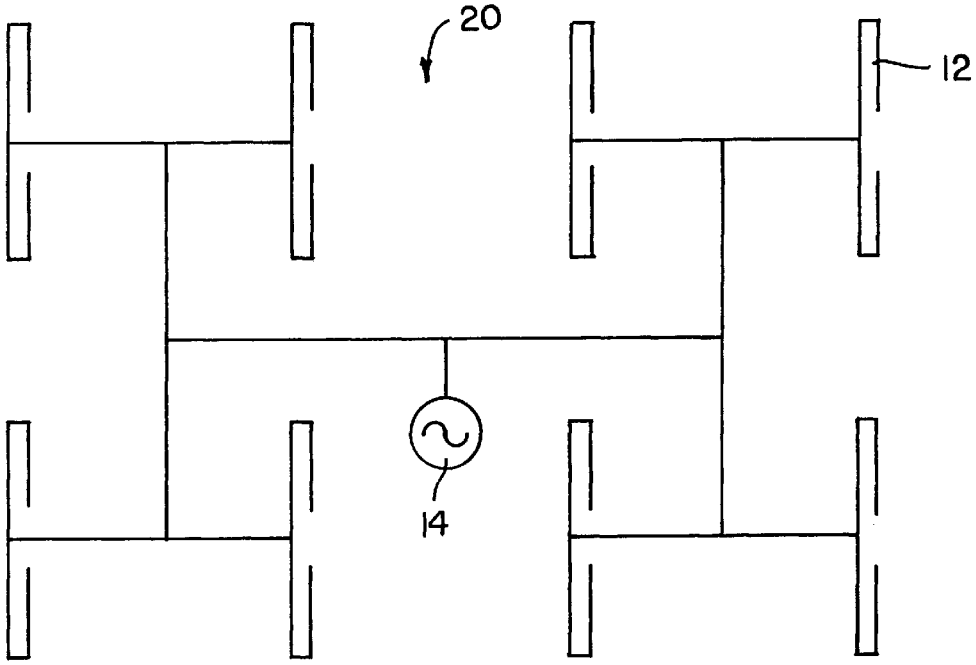
FIG. 4*a* is an illustration of a dipole array showing the planar layout of the microstrip driving circuit.
Figure 4B:
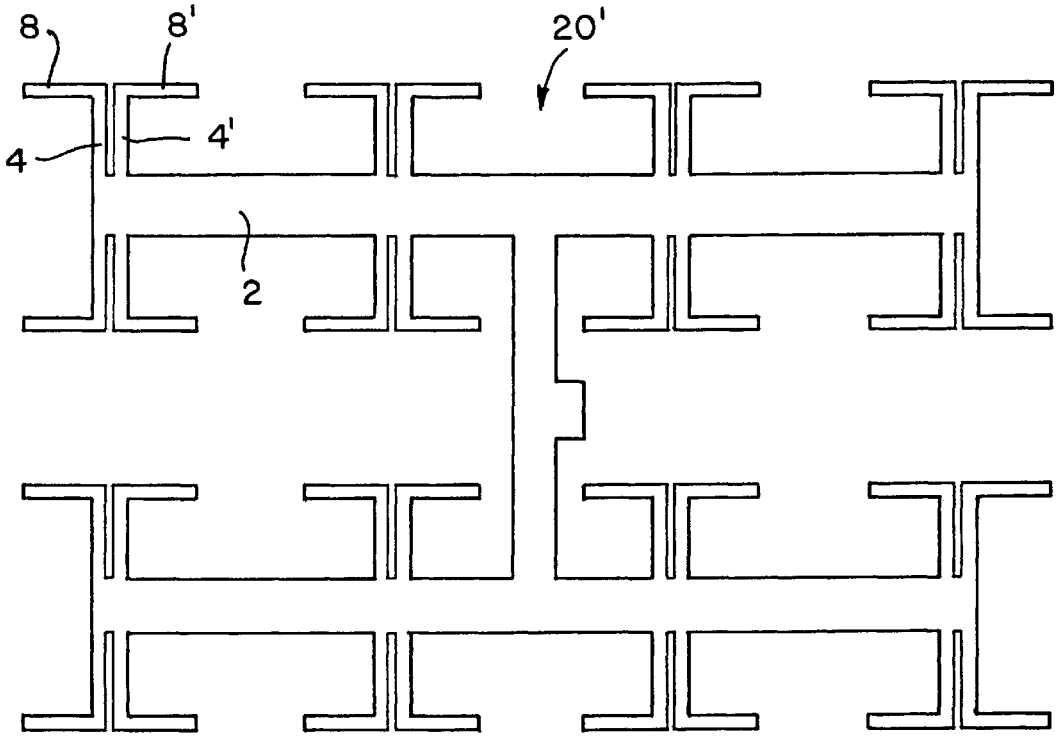
FIG. 4b PRIOR ART
FIG. 4*b* is an illustration of a typical dipole array showing the planar layout of the ground plane and conventional dipole antenna structures.

All layers in the improved antenna structure are in parallel planes, including the dipole and balun layers, and are perpendicular to the radiation axis resulting in a simple and economical layered construction which can be inexpensively and easily fabricated on dielectric sheets to form planar antenna arrays. FIG. 4*a* shows a typical layout of the circuit plane containing an array of unbalanced transmission lines 12 arranged in a microstrip array configuration over a dielectric substrate 20. FIG. 4*b* shows a conventional layout of the ground plane containing the ground plane portion of the balun and conventional dipole elements over a dielectric substrate 20'.

In operation, a dipole element will produce a toroid-shaped free space radiation pattern with the dipole arms extending from the center of the torus along its axis. In an ideal array of symmetrically arranged dipole elements, the radiation patterns will multiply with the array factor to produce a radiation pattern which, when viewed from a distance, becomes directional extending normal to the plane of the array.

In a real antenna array, each element radiates independently and is affected by its surroundings. Since even the most careful arrangement of antennas will be asymmetric at the array boundaries, the overall radiation pattern can suffer from a shaping and steering effect where the shape of the radiation pattern is altered by the asymmetries. When this occurs, the directivity of the radiation pattern as viewed from a distance can shift several degrees from normal. A primary goal is therefore to arrange the array to be as symmetric as possible.

The present invention alleviates this shaping and steering effect by surrounding each antenna within a planar array with the ground plane. Circumscribing each radiating element in this way improves the shape of the radiation pattern by making the array environment as seen by each element more symmetric. The greatest improvement by this modification to the antenna array geometry is to elements located at the array boundaries.

Figure 4C:
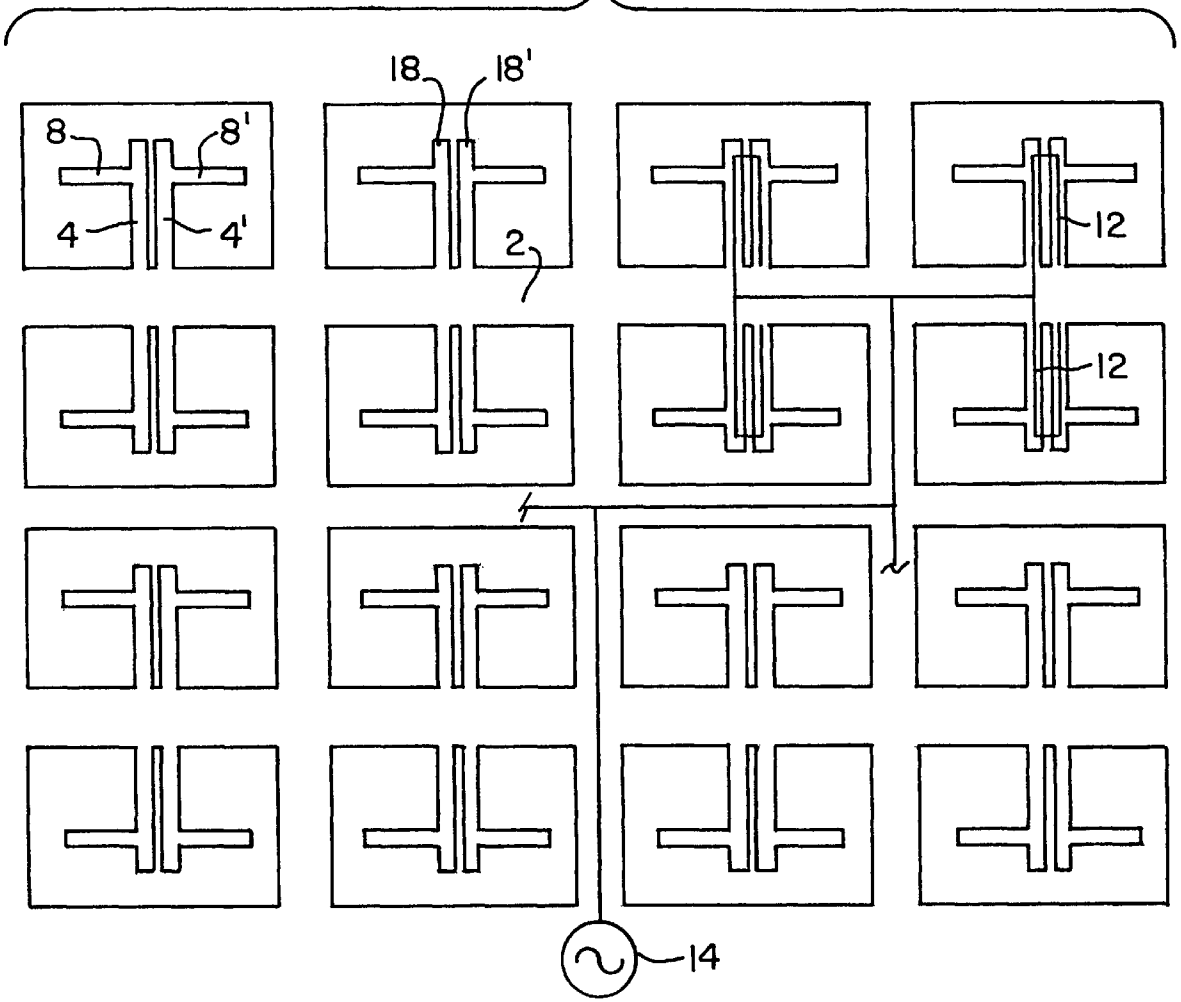
FIG. 4*c* is an illustration of a dipole antenna array according to the present invention with the ground plane framing each antenna and the microstrip driving circuit shown superimposed over a representative set of dipole elements.

Generally, each radiating element can be circumscribed by a ground plane extension of any shape. To avoid high coupling between each dipole radiating element and the surrounding ground plane which will created unwanted co- and cross-polar radiation, the ground plane should be kept approximately $L_{high}/8$ or greater from the dipole arms. FIG. 4*c* shows the planar array of FIG. 4*b* where each antenna is modified according to the present invention to include stubs 18, 18' and the array is further modified to circumscribe each element by a ground plane 2. Also indicated in FIG. 4*c* is microstrip driving circuit 12 of FIG. 4*a* shown superimposed over a representative set of dipole elements. The insulating spacer 36 between the two planes is not shown.

A further improvement in the antenna array is obtained by placing a electromagnetic radiation reflecting plane 40 between approximately $L_{high}/4$ to $L_{low}/4$ below the plane of the array and parallel to it. The reflecting plane may be separated from the array by a dielectric spacer 38. FIG. 4*d*. The reflected radiation wave will be approximately in phase with the direct wave radiating from the top of the array resulting in the field strength above the array being approximately doubled.

The preferred embodiment of the invention includes an array of broad band dipole elements. The ground plane and circuit plane are arranged as described above and as illustrated in FIG. 4*c*. The patterns for the ground and circuit planes are formed on non-conducting substrates, such as flexible sheets of polyester. One method of forming the patterns is by fully coating the substrate with a conducting material, such as aluminum, and then removing the unwanted aluminum by chemical etching. Other usable methods for forming the ground and circuit planes include printing or silkscreening onto polyester sheets using, for example, a silver-based electrically conducting ink.

The ground and circuit planes are separated by a low-loss dielectric spacer. Low losses are achieved by making the spacer from a low density dielectric foam such as 6 pounds/cubic foot polyethelene foam. Successful results have also been achieved with 3 pounds/cubic foot polyethelene foam. Lower density foams cause lower loss as the electric field propagates between the circuit and ground planes but may be harder to accurately manufacture in thin sheets.

The geometric dimensions of the antenna determine the operating frequency range of the array. The thickness of the spacer and the width of the unbalanced transmission line circuits determine its characteristic impedance. The geometry of each antenna including the length of the dipole arms, the length of the stubs, the thickness of the spacer, the width of the unbalanced transmission line, and the layout of the antenna array are parameters which can be selected by someone skilled in the art to provide an antenna array with the desired operating characteristics.

A representative embodiment of the antenna according to the present invention has a dipole radiating element measuring 2.2 inches from end to end. The width of the dipole arms and each ground plane extension is 0.25 inches. The channel has a width of 0.050 inches and a length of approximately 1.45 inches. The dipole arms thus extend 0.825 inches from the edge of each ground plane extension. The stubs extend 0.275 inches beyond the dipole arms. The ground plane circumscribes each antenna element as illustrated in FIG. 4*c*.

The circuit plane is separated from the ground plane by a spacer having a thickness of 1/32 inches. Each unbalanced transmission line has a width of 0.080 inches and is arranged as illustrated in FIGS. 4*a* and 4*c* and positioned so as to run up or down the center of each underlying ground plane portion of the balun leaving an uncovered outer border on each ground plane extension of about 0.08 inches. The unbalanced transmission line crosses the channel near the top of the stubs, leaving an uncovered upper border also of about 0.08 inches. The unbalanced transmission line terminates even with the end of the channel.

The representative embodiment also has a reflecting plane made of a conducting material such as aluminum. The reflecting plane is located approximately 1 inch below the ground plane and can be separated from it by a very low-density foam such as a 1 pound/cubic foot foam used to make packing materials.

An antenna constructed with these dimensions has an operating range spanning approximately 2 to 3.5 GHz and a characteristic impedance of 50 ohms. As is well known in the art, a measure of conventional dipole antenna bandwidth can be defined as the bandwidth where the voltage wave standing ratio (VSWR) is less than 2:1. When the VSWR is less than 2:1, typical dipole antennas can operate with a frequency range that varies by about 15% to 20%. With the addition of the stubs as described above, the operating bandwidth of an improved dipole antenna can approach 50% while keeping the VSWR<2:1, giving upwards of a 2.5× improvement. Forming an array of these antennas, surrounding each antenna element with the ground plane and positioning a reflecting plane one-quarter wavelength behind the array results in a high bandwidth dipole antenna array with superior directivity and radiation efficiencies of 80% that can be easily and inexpensively fabricated and assembled.

What is claimed:

1. A broad band dipole antenna comprising:

(a) a balun element comprising:

(i) first and second ground plane extensions;

(1) each said ground plane extension having a first end and a second end;

(2) said second ends in electrical contact with each other;

(ii) an unbalanced transmission line positioned generally on top of said ground plane extensions; and (iii) an insulator in between said ground plane extensions and said unbalanced transmission line;

(b) a dipole radiating element comprising two dipole arms, wherein (i) each dipole arm is connected to and extends from a corresponding ground plane extension; and (ii) each dipole arm is positioned on the corresponding ground plane extension at a point intermediate to said first and second ends of each said ground plane extension;

(c) a stub region defined by a portion of each ground plane extension extending beyond the dipole arm to said first end of said ground plane extension; said unbalanced transmission line extending into the stub region of each ground plane extension.

2. An antenna as set forth in claim 1, wherein (a) said ground plane extensions are substantially parallel and separated by a channel; and (b) said unbalanced transmission line having a source region, a channel region, and a reflecting region; said source region connected to said channel region; said channel region connected to said reflecting region;

(i) said source region positioned over said first ground plane extension and extending from said second end of said first ground plane extension to the corresponding dipole arm;

(ii) said channel region being generally U-shaped and positioned over said first ground plane extension from the corresponding dipole arm into the first stub region, across the channel region and over the stub region of the second ground plane extension, continuing over said second ground plane extension to the corresponding dipole arm;

(iii) said reflecting region positioned over said second ground plane extension from the corresponding dipole arm to said second end of said second ground plane extension.

3. An antenna as set forth in claim 2, wherein (a) said dipole arms have substantially the same length and are arranged collinear with respect to each other, and (b) said ground plane extensions have substantially the same length.

4. An antenna as set forth in claim 3, wherein (a) said antenna having an efficient operating range extending between frequencies $f_{high}$ and $f_{low}$ with corresponding operating wavelengths $L_{high}$ and $L_{low}$, $f_{high}$ being greater than $f_{low}$ and $L_{high}$ being less than $L_{low}$, the difference between $L_{low}$ and $L_{high}$ defining dL;

(b) said ground plane extensions each having a length approximately $L_{low}/4$;

(c) said dipole arms each having a length approximately $L_{high}/4$ and extending substantially normal to the corresponding ground plane extension away from the channel region at a point approximately $L_{high}/4$ from said second end of the corresponding ground plane extension;

(d) said channel region of said unbalanced transmission line being substantially U-shaped, wherein the legs of the U are positioned over each corresponding ground plane extension, said legs each having length approximately dL/4 ; and (e) said reflecting region having length approximately $L_{high}/4$.

5. An antenna as set forth in claim 1, wherein the radiating element and transmission line are formed from a plurality of electrically conductive planes separated by a dielectric spacer.

6. An antenna as set forth in claim 5, further comprising:

(a) at least one ground plane;

(b) a circuit plane substantially parallel to said ground plane and separated therefrom by said dielectric spacer, said circuit plane including said unbalanced transmission line; and (c) said ground plane having a coplanar protuberance a central slot to thereby form said ground plane extensions, said ground plane extensions positioned relative to said unbalanced transmission line to form said balun element; said dipole arms extend from said ground plane extensions and are substantially coplanar with the ground plane.

7. A planar antenna array including a plurality of antennas as set forth in claim 6, wherein said ground plane is common to each said antenna in said array, thereby electrically connecting said plurality of antennas in said array to each other.

8. A planar antenna array as set forth in claim 7, wherein at least a portion of each antenna in said array is substantially circumscribed by the ground plane.

9. A planar antenna array as set forth in claim 7, further comprising an electromagnetic reflecting plane placed substantially parallel to said array.

10. A planar antenna array as in claim 7, wherein each antenna in said array is substantially identical;

at least one of said antennas in said array having an operating range extending between frequencies $f_{high}$ and $f_{low}$ with corresponding operating wavelengths $L_{high}$ and $L_{low}$, $f_{high}$ being greater than $f_{low}$ and $L_{high}$ being less than $L_{low}$;

said antenna array further comprising an electromagnetic reflecting plane placed substantially parallel to said array at a distance from said ground plane of between approximately $L_{high}/4$ to $L_{low}/4$.

11. A planar antenna array as set forth in claim 10, wherein at least a portion of each antenna in said array is substantially circumscribed by the ground plane.

12. A planar antenna array as set forth in claim 11, wherein said dielectric spacer comprises a low-density dielectric foam.

13. An antenna as set forth in claim 1, further comprising:

at least one ground plane;

a circuit plane substantially parallel to said ground plane and including said unbalanced transmission line;

said ground plane extensions comprising coplanar protuberances extending from said ground plane and separated by a central slot, said ground plane extensions positioned relative to said unbalanced transmission line to form said balun element; said dipole arms extend from said ground plane extensions and are substantially coplanar with the ground plane.

14. A planar antenna array including a plurality of antennas as set forth in claim 13, wherein said ground plane is common to said plurality of antennas in said array, thereby electrically connecting said antennas in said array to each other.

15. A planar antenna array as set forth in claim 14, wherein at least a portion of each antenna in said array is substantially circumscribed by the ground plane.

16. A planar antenna array including a plurality of antennas as set forth in claim 13, further comprising an electromagnetic reflecting plane placed substantially parallel to said array.

17. An antenna as set forth in claim 13, further comprising a dielectric spacer separating said circuit plane from said at least one ground plane.

* * * * *